US012716322B2

(12) United States Patent
Stewart et al.

(10) Patent No.: US 12,716,322 B2
(45) Date of Patent: Aug. 25, 2026

(54) INTERVENTION SYSTEM FOR EFFICIENT SEALING

(71) Applicant: Expro North Sea Limited, Dyce (GB)

(72) Inventors: Chris Stewart, Dyce (GB); Hannah Stewart, Dyce (GB); Dylan Johnston, Stirling (GB)

(73) Assignee: Expro North Sea Limited, Dyce (GB)

( * ) Notice: Subject to any disclaimer, the term of this patent is extended or adjusted under 35 U.S.C. 154(b) by 0 days.

(21) Appl. No.: 18/376,622

(22) Filed: Oct. 4, 2023

(65) Prior Publication Data

US 2025/0116171 A1 Apr. 10, 2025

(51) Int. Cl.
*E21B 33/14* (2006.01)

(52) U.S. Cl.
CPC ..... *E21B 33/14* (2013.01)

(58) Field of Classification Search
CPC ..... E21B 33/13
See application file for complete search history.

(56) References Cited

U.S. PATENT DOCUMENTS

| | | | | |
|---|---|---|---|---|
| 4,802,534 | A * | 2/1989 | Larson | E21B 33/13 166/381 |
| 11,274,519 | B1 * | 3/2022 | Helms | E21B 33/14 |
| 2004/0084184 | A1 * | 5/2004 | Orban | E21B 33/13 166/66.5 |
| 2006/0016599 | A1 * | 1/2006 | Badalamenti | E21B 33/14 166/285 |
| 2010/0186955 | A1 * | 7/2010 | Saasen | C09K 8/422 166/65.1 |

* cited by examiner

*Primary Examiner* — William D Hutton, Jr.
*Assistant Examiner* — Avi T Skaist
(74) *Attorney, Agent, or Firm* — Getz Balich LLC

(57) ABSTRACT

System and methods for efficient sealing within an annulus outside the casing of a subterranean wellbore using annulus intervention insertion system are disclosed. Some examples describe a system that includes a magnetorheological cementitious material and a magnetic field induced by electromagnet provided inside the wellbore. Efficient cementing is achieved by holding the magnetorheological cementitious material to in the desired position by the magnetic forces of the electromagnet; and allowing the magnetorheological cementitious material to harden and set in the annulus.

5 Claims, 7 Drawing Sheets

INTERVENTION SYSTEM FOR EFFICIENT SEALING

BACKGROUND OF THE INVENTION

1. Technical Field

The present disclosure relates to oil and gas wells in general, and to intervention systems for oil and gas wells in particular.

2. Background Information

Oilwells are drilled for different purposes, as producers of hydrocarbons; injectors of water or gas for reservoir pressure support or for depositing purposes; or as exploration wells. Over time, at some point, it becomes necessary to plug and seal these wells, say, when the ability of a wellbore to produce hydrocarbons starts to decrease and hydrocarbons can no longer be produced from the wellbore, or for some temporary purpose (e.g. "slot recovery" to seal off a reservoir to facilitate reuse of parts of the existing well to reach a new target). At that time, it is imperative that the wellbore must either be abandoned by effectively plugging the wellbore, or, temporarily plugged for future reuse. To plug the wellbore, a cementitious mixture is flowed into the wellbore at desired depths where the mixture hardens to form a plug. This plug will thus prevent fluids from the subterranean zone from flowing into the well and back to the surface, or preventing zonal contamination or leakages. Oil and gas industry guidelines require the plug to have a significant length of "good cement", so that a plug has an effective bond with a surrounding casing and/or tubing and/or formation with no cracks, channeling or slumping, and that it has attained the desired compressive strength. The nature and quality of the cementitious material used for plug and abandonment plays a critical role in the ecological health of the wellbore as the plug must withstand the pressures and temperatures and continue to serve as an effective seal for a very long time. Any crack or break in the plug can have a drastic ecological consequence. However, in the complicated underwater operations, it is difficult to provide the ideal conditions for improved efficiency of the plugging material.

One of the major drawbacks of using traditional cementing materials such as conventional hydraulic cement in plugging is that such materials are not able to achieve effective leak-proof seals. Further, methods employing non-cement plugging agents have been attempted with materials such as resins and/or polymers. Even combinations of non-cement and cementing materials have been attempted, but ultimately proven unsuccessful. One obstacle with high pressure deep wells is that the plugging components or cementitious material cannot always flow into the exact position or area necessary to create an ideal seal. Existing methods are not accurate, the cementitious material tends to break down prior to reaching the desired zone. There are many problems encountered when using fluid columns to form a base for cement plug, as the fluid column is not static, it effects the cement by causing fluid loss or inflow while setting. Using mechanical plugs to be set as a base for the cement plug is also not feasible as installing a mechanical plug into an annular region between two sizes of casing is not possible as there is no accessibility to the annular region. Three methods are commonly used to overcome the problem of lack of accessibility to the annulus: the first commonly used method is to run a tool down into the wellbore to cut and pull a portion of casing, but this method is risky, time consuming, expensive and hazardous to health and environment. The second commonly used method involves running a milling device into the wellbore and cutting/milling away some of the casing, followed by cementing in the milled section. This method generates a lot of metal cuttings and debris, which tangle together and form blockages causing issues in the wellbore and for surface equipment. In the third method, explosive charges are used to perforate a lower end of the tubing and then cement or sealing fluid is pumped through the perforations so as to plug the well around the bottom end of the tubing. For this method to work, cleaning fluids must be injected into the wellbore to remove the debris first, but there is no method to know or determine where the cement has been placed. This leads to annular cement jobs often not having circumferential bonds or having significant contaminations and/or slumping problems.

Recently, the use of magnetorheological cement (MRBC), cement mixed with magnetic particles, is being considered. These magnetic particles allow the cement mixture to be held in place by a magnet until the cement is hardened, thus ensuring efficient and uniform cement setting. Some common uses of magnetorheological fluids in well environments include logging, fluid valve systems, flow control, packers, cementing and plugging a wellbore for temporary purposes such as well maintenance or permanent purposes like P&A (plug and abandonment). P&A processes are done to create a barrier downhole to prevent flow from or into the well. In conventional P&A the abandonment plug is usually made up of cement, and the cement path travels down the interior of the casing, and thru perforations in the casing, into the annulus. Also, normally, MRBC slurry would have to be pumped through the casing to the bottom of the wellbore and then moved upwardly through the annulus until the desired zone has been filled with MRBC slurry. Drawbacks of such methods are that unnecessarily large volumes of MRBC slurry will have to be used, the likelihood of contamination is high and there is no accuracy in positioning of the MRBC. Thus, all the common methods are complicated, time-consuming and require specialized equipment and a full drilling unit. While there are numerous systems and methods for cementing and P&A, they suffer from a consideration of only one or two aspects of annular cementing or plug formation in the annulus of the wellbore, thus, there is a need in the art for improved systems and methods that are capable of creating an optimal cementing or plugging operation based on formation properties and characteristics by iteratively optimizing all facets/aspects of the annulus cementing operation. Consequently, there is a need for development of a simplified and accurate sealing technique to fill specific parts of the annulus in an efficient manner.

SUMMARY

The present disclosure includes examples of a system and method for overcoming the above limitations of prior art. According to at least some examples, this objective is achieved by making use of magnetorheological cement (MRBC). The MRBC is directly pumped into the annulus while a magnetic apparatus is placed inside the wellbore and used to hold the MRBC cement in place while the cement cures and solidifies.

The present invention employs the use of innovative well intervention technique in the form of a unique, patented, OCTOPODA® system to access the annulus of the wellbore in a minimally intrusive manner, and filling the specific parts of the annulus directly with magnetorheological cement (MRBC). A magnetic tool is previously placed inside the wellbore to hold the MRBC cement in place while the cement cures and solidifies.

The present invention ensures that MRBC will directly enter the annulus without having to circulate through the wellbore. Therefore, much lesser quantity of cement is used in comparison with conventional techniques, thus making this approach more precise, environmentally friendly and economical.

The method of the present invention further effectively avoids plugging and damaging of the inside of casing, and also avoids the need to perforate tubular(s).

The present invention aims to achieve all the above benefits without the expense or environmental footprint of a heavy workover rig, has reduced rig time, resulting in significantly reduced costs. The present invention does away with the conventional methods of perforating or removing the casing. Hence, environmental and ground water protection is achieved, thus creating a more environmentally friendly approach towards cementing.

The foregoing summary is intended merely to introduce a subset of the features more fully described of the following detailed description. Accordingly, this summary should not be considered as limiting.

BRIEF DESCRIPTION OF THE DRAWINGS

The accompanying drawings, which are incorporated in and constitute a part of this specification, illustrate an embodiment of the present disclosure and together with the description, serve to explain the principles of the present disclosure.

DETAILED DESCRIPTION OF THE INVENTION

Figure 1A:
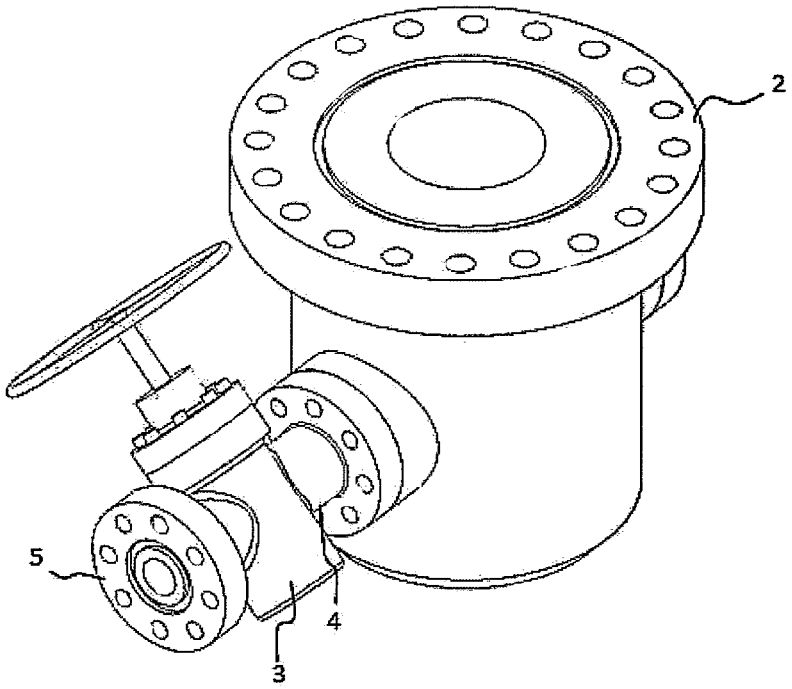
FIG. 1A is a perspective view of a wellhead with an annulus port including a valve attached thereto.

Reference will now be made in detail to embodiments of the present disclosure, examples of which are illustrated in the accompanying drawing. In the drawings, like reference numerals have been used throughout to designate identical elements, where convenient. The following description is merely a representative example to illustrate the scope of the present disclosure.

Some embodiments of the present disclosure provide a system, method and apparatus for quick and efficient cementing technique for sealing within the annulus outside of the casing, in which the conventional time-consuming, cumbersome, inaccurate and risk-prone methods of feeding the cement slurry through perforations in the casing are mitigated and/or avoided. When filling difficult to access annular areas outside the casing with cement, a certain amount of precision is called for. Embodiments of the present disclosure provide a quick and precise system that makes use of magnetorheological cement (MRBC) to achieve this purpose, where the cement is mixed with magnetic particles. The benefits of employing MRBC in the present system include efficient manipulation of cement, elimination of the liquid setting phase of conventional cement, avoiding gravitational movement or slumping during the liquid phase, impeding mechanical movement and flow of hydrocarbons during the setting phase, as well as strong, solid bond. The benefits of using MRBC over traditional cement include accurate placement, installation without the need for a bottom plug, solid circumferential bonds, less slumping issues, and less contamination. Compressive strengths of MRBC shows better results with MRBC showing slightly higher early strength. Pressure testing demonstrate that the MRBC fluid columns are able to hold more than the minimum goal of 345 kPa (50 psi) of pressure and this characteristic of MRBC can be exploited to form temporary and permanent cement barriers both inside casing and open hole, as well as in casing annuli. For the latter application, sufficient magnetic field strength (in the range of 0.15 T-0.25 T) can be generated in the annular space outside of a stainless-steel casing with the magnet located inside the casing, to still effectively magnetize the MRBC slurry.

Figure 1B:
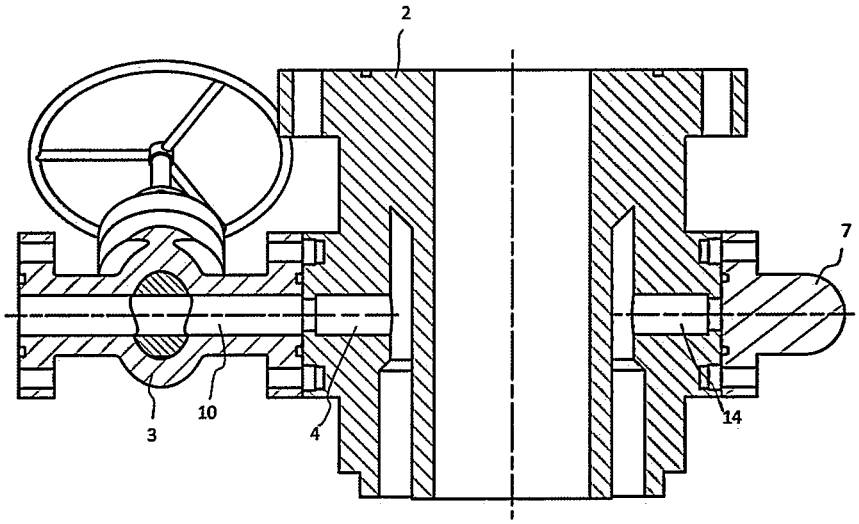
FIG. 1B is a sectional view of the wellhead and valve of FIG. 1A.
Figure 2:
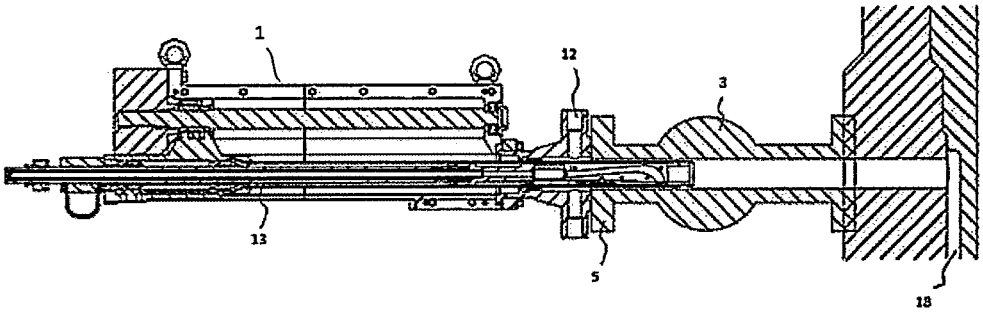
FIG. 2 illustrates the annulus intervention insertion system installed on to the well head valve.

According to aspects of the present disclosure, FIG. 1A diagrammatically illustrates a wellhead 2 to which an apparatus comprising an annulus intervention insertion device 1 will be connected. The wellhead 2 is of a standard construction with an annulus port 4 and a valve 3 attached thereto. The valve 3 is normally a gate valve, which when closed shuts off access to the annulus port 4. FIG. 2 shows the wellhead assembly of FIGS. 1A and 1B with annulus intervention insertion device 1 attached to the outboard flange 5 of the annulus valve 3. To facilitate the description herein, the aforesaid structure will be referred to hereinafter generically as annulus intervention insertion device 1. Also seen in FIG. 2, the annulus intervention insertion device 1 is attached to outboard flange 5 of valve 3. The annulus intervention apparatus shaft 13 is initially shown as retracted.

Figure 3:
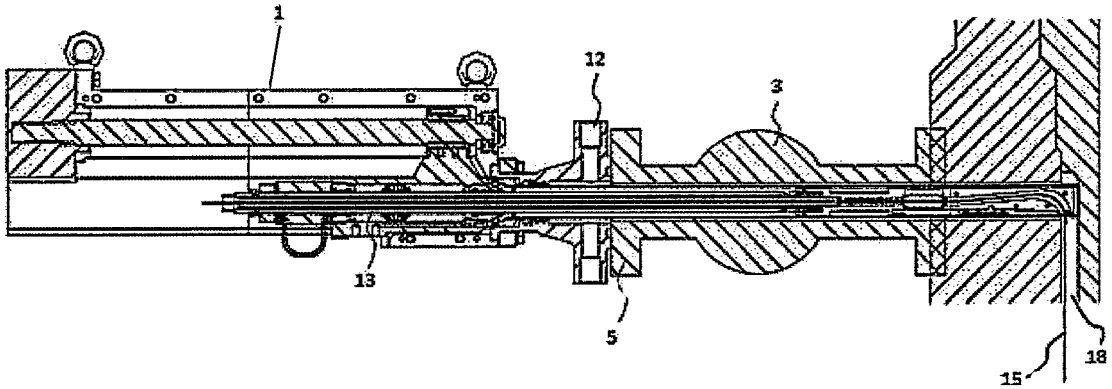
FIG. 3 illustrates the annulus intervention insertion system extended into the valve and the hose deployed into the annulus.
Figure 4:
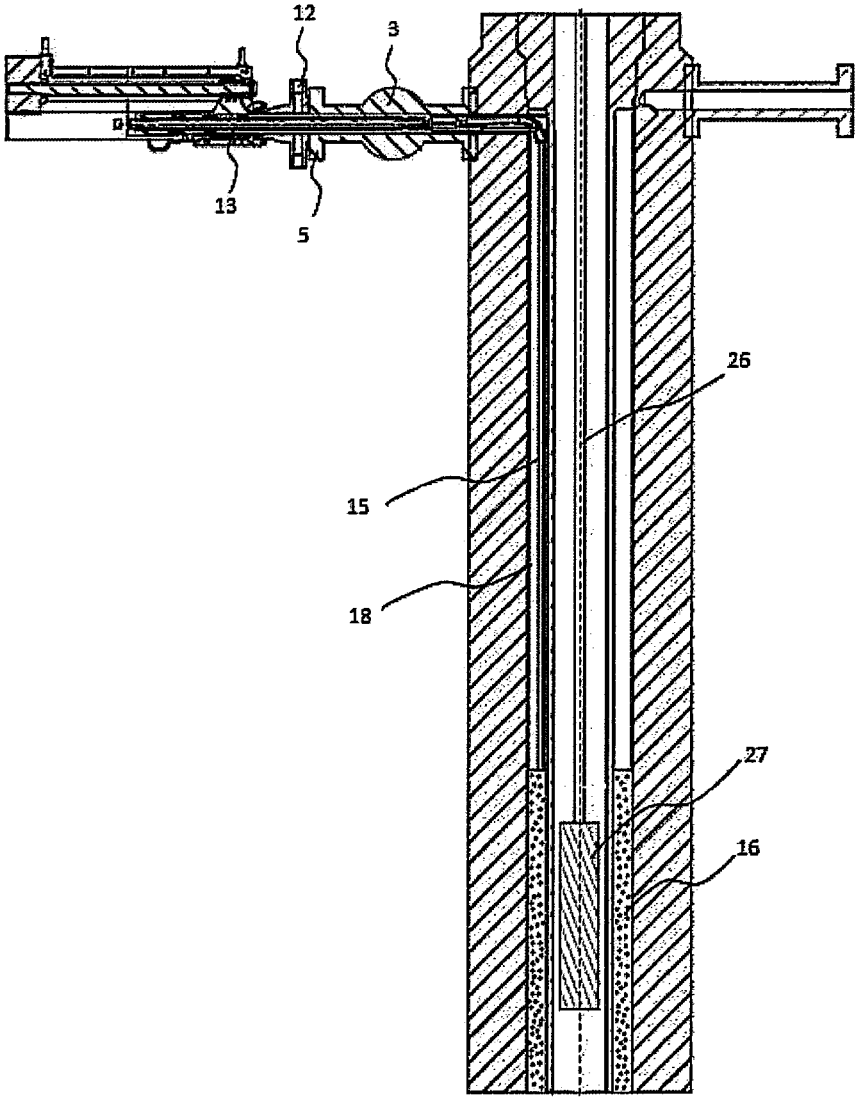
FIG. 4 illustrates a cross-sectional view of the preferred embodiment.
Figure 5:
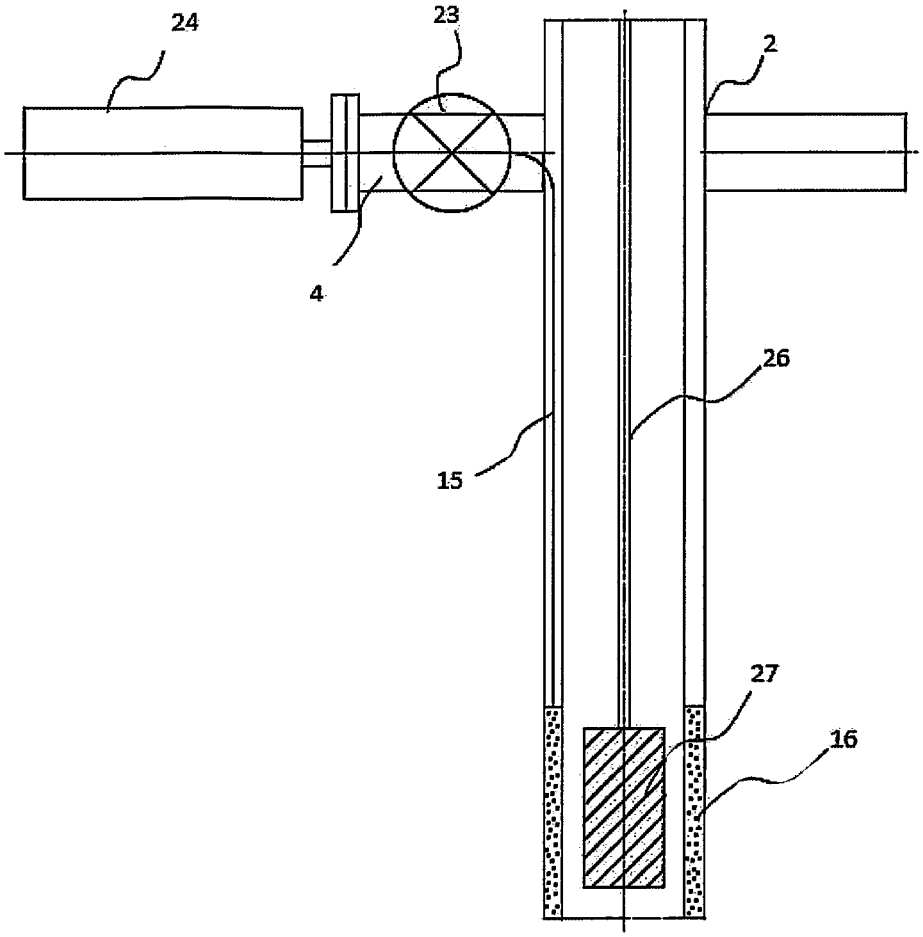
FIG. 5 illustrates schematically how-a cross-section of the preferred embodiment.
Figure 6:
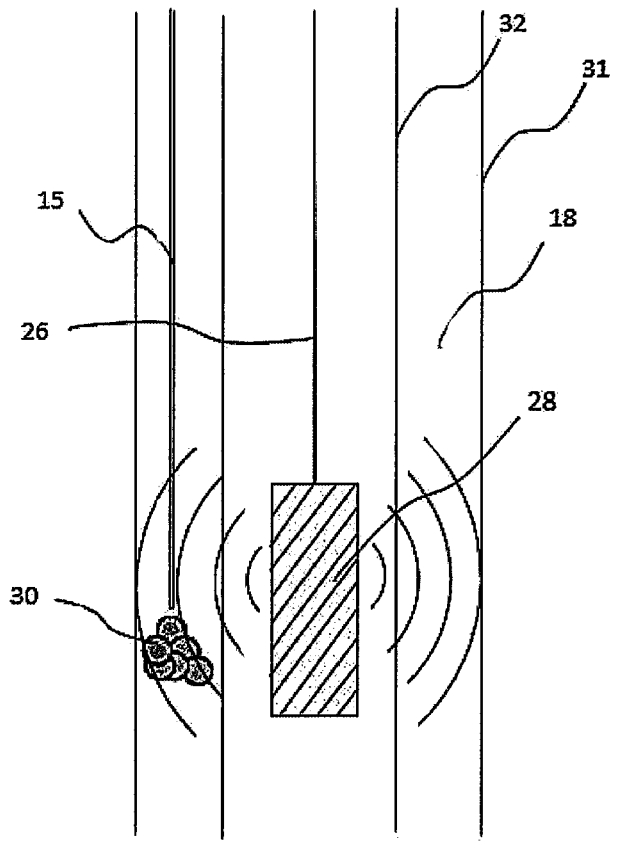
FIG. 6 illustrates a cross-sectional view of an alternative embodiment.

As seen in FIG. 3 the annulus intervention apparatus shaft 13 is extended, thereby extending the annulus intervention apparatus 1 and hose 15 deployed into the annulus 18. Full extension indicates that there is no debris or obstruction present in the valve or passageway between the valve and the annulus. The annulus intervention hose 15 is fed into the annulus 18, as seen clearly in FIG. 4, and it reaches the required cementing depth. Then the MRBC 16 travels through hose 15 directly into the annulus 18. A wireline electromagnet tool (WEM) 27 is the magnetic field inducing member that is suspended by a cable, coiled tubing, patented CoilHose® system or wireline 26, and is positioned inside the wellbore at the approximate cementing depth. This is activated by inducing, via the magnetic field inducing member, a magnetic field for affecting the physical properties of the magnetorheological cementitious slurry and for defining a lower boundary for the cement plug. The mobility of the MRBC 16 is controlled by the magnetic field of the WEM 27, such that the movement and setting is manipulated as required. The MRBC 16 is held in place by the forces of WEM 27 and is allowed to solidify accordingly while held in the desired place. An important advantage of using MRBC is that it has the inherent ability to change its viscosity or stiffness in response to the applied magnetic field, thus enabling it to adapt and provide variable sealing properties. It is important to note that the magnetorheological cementitious slurry is consolidated substantially at the lower boundary without the need for a base device in the annular region. Once the desired setting is achieved, WEM 27 is removed. In an alternative embodiment illustrated in FIG. 6, the annulus intervention hose 15 is fed into the annulus 18 to provide the sealing material with low melting point, which could be metallic beads or metallic alloy beads such as bismuth alloy beads 30, to flow into the annulus 18 at the determined location. Alternatively, instead of metallic beads, polymers, resins, silicates or combinations of the same, can be used. A heat source 28 is suspended by a cable, coiled tubing, patented CoilHose® system or wireline 26 and positioned at the desired region to radiate heat to cause the sealing material to melt. The molten material is able to flow efficiently within the required region in the annulus, thus effectively distributing itself entirely around the annulus. All the gaps and crevices are efficiently filled due to the flow of the molten material. When the heat source 28 is removed, the molten material is able to cool down and harden and set in place, creating a plug.

The foregoing describes preferred embodiments of the invention and is given by way of example only. The invention is not limited to any of the specific features described herein but includes all variations thereof within the scope of the appended claims.

The invention claimed is:

1. A method of sealing an annulus outside the casing of a subterranean wellbore with a plug, comprising:

providing an annulus intervention insertion device having a hose, wherein the hose has a distal end;

feeding the hose into the annulus of the well bore until the distal end of the hose is disposed at a sealing depth position within the annulus of the well bore;

suspending a controlling device inside the wellbore adjacent the sealing depth position, wherein the controlling device is controllable to produce a magnetic field;

directing a sealing material in a slurry form through the hose and directly into the annulus, wherein the sealing material in the slurry form exits the distal end of the hose and enters the annulus at the sealing depth position;

holding the sealing material in the slurry form at the sealing depth position by controlling the controlling device to produce the magnetic field having a magnetic field strength; and varying a physical property of the sealing material in the slurry form by varying the magnetic field strength of the magnetic field;

wherein the step of holding the sealing material in the slurry form at the sealing depth position is continued until the sealing material solidifies into a solid plug of sealing material within the annulus.

2. The method of claim 1, wherein the sealing material is magnetorheological cement; and wherein the controlling device is an electromagnet.

3. The method of claim 2, wherein the physical property of the sealing material in the slurry form is a viscosity of the sealing material in the slurry form.

4. The method of claim 2, wherein the step of varying the physical property of the sealing material in the slurry form includes varying the magnetic field strength of the magnetic field to vary the viscosity of the sealing material in the slurry form to cause the sealing material in the slurry form to flow in a manner that allows the sealing material in the slurry form to fill voids present in a formation contiguous with the wellbore.

5. The method of claim 1, wherein during the step of holding the sealing material in the slurry form at the sealing depth position, the sealing material in the slurry form consolidates at a sealing material lower boundary within the annulus.

* * * * *